United States Patent [19]

Schüttler

[11] 4,058,267

[45] Nov. 15, 1977

[54] WEB SPOOLING MACHINE

[75] Inventor: Wilhelm Schüttler, Buchenwinkel, Germany

[73] Assignee: Maschinenfabrik Stahlkontor Weser Lenze KG, Aerzen, Germany

[21] Appl. No.: 710,113

[22] Filed: July 30, 1976

[30] Foreign Application Priority Data

Aug. 2, 1975 Germany ..... 2534588

[51] Int. Cl.[2] ..... B65H 19/20

[52] U.S. Cl. ..... 242/56 A; 83/587

[58] Field of Search ..... 242/56 A, 56 R, 64, 242/76; 83/586, 587; 267/154

[56] References Cited

U.S. PATENT DOCUMENTS

| | | | |
|---|---|---|---|
| 3,395,870 | 8/1968 | Klinger | 242/76 X |
| 3,501,104 | 3/1970 | Hellemans | 242/56 R |
| 3,871,595 | 9/1975 | Smolderes | 242/56 A |
| 3,872,754 | 3/1975 | Haas | 83/587 |

*Primary Examiner*—Edward J. McCarthy
*Attorney, Agent, or Firm*—Edwin E. Greigg

[57] ABSTRACT

A web spooling machine with automatic spool changing equipment in which an empty spool is placed against the web between the feed roller and the full spool. Pivoting arms carry a cutter blade which cooperates with a pivoting anvil or counterblade to sever the web. At the same time, an elastic guide engages the severed end of the web to guide it over the new spool while a pressure roller keeps it in place. The cutter blade is propelled into the path of the moving web by a torsional spring which is wound up by a cam follower whenever the mechanism returns to its starting position.

5 Claims, 3 Drawing Figures

WEB SPOOLING MACHINE

BACKGROUND OF THE INVENTION

The invention relates to web spooling machinery running at high velocity and including devices for the automatic changeover from a filled-up spool to an empty one. The web spooling machinery to which this invention relates also includes a mechanism for severing the web and for guiding the severed end of the web onto the empty spool to continue the wind-up process thereon.

A machine of the above-described type has been proposed in which a reversing roller is associated with a pivotable knife which may be pivoted by an energy source acting through a gear train. The disposition of the severing knife on the shaft of the reversing roller causes the device to occupy only a small volume while the use of an energy storage mechanism for driving the pivotable knife imparts thereto a very high starting velocity and thus a very rapid severing speed. The severing speed may be as much as twice as great as the transport velocity of the web so that very sensitive webs running at high velocity, for example thin polyester foils for recording tapes, may be severed perpendicularly to the direction of motion of the web without any bunching or folding and may be securely attached to the new empty spool without requiring the use of adhesives.

In the practical application of the above-described known apparatus it has been demonstrated that it is only suitable for perpendicular severing of webs of foil which are no thicker than 0.05 millimeters and furthermore are capable of sustaining a relatively high tensile stress during the cutting. If the material is any thicker than 0.05 millimeters, the severing knife is no longer capable to make a clean cut as soon as it encounters the foil but, instead, the foil moves away from the knife to a greater or lesser degree so that no cut can take place or can take place only so far away from the intended position at which the end of the web may securely attach to the empty spool that it can no longer be smoothly attached to the spool without the creation of a fold-over.

OBJECT AND SUMMARY OF THE INVENTION

It is a principal object of the invention to provide a web spooling machine of the above-described type which is so improved that even hard foils of a thickness up to 0.5 millimeters and soft foils up to 1 millimeter thickness may be cleanly and securely severed during the web motion and may be securely and without folding attached to the new empty spool.

These and other objects are attained according to the invention by providing a geared pivotable severing knife, driven by an energy storage mechanism and disposed pivotably about the shaft of a reversing roller. In addition thereto, the machine according to the invention provides an anvil pivotably disposed to cooperate with the severing knife so as to prevent the lateral motion of the web during the cut.

The anvil may be brought into its operative position in which it cooperates with the severing knife by any suitable hydraulic or pneumatic mechanism and its presence has the effect that the cut will always take place at the same well-defined location which is most suitable for a secure attachment of the severed portion of the web to the new spool even for materials of substantial thickness.

In a preferred exemplary embodiment of the invention, there is provided an elastic sheet-metal guide having an approximately semicircular cylindrical shape substantially adapted to the shape of the empty spool and capable of being moved into a position near the empty spool so as to smoothly guide the end of the web onto the empty spool. At the end of the guiding movement, the sheet metal guide lifts off from the empty spool due to its own elasticity and does not interfere with the winding of the web on the new spool.

A further feature of the invention is that there is provided a pressure roller which engages the new spool elastically and presses the web onto the empty spool until it is held thereon by the sheet metal guide.

The invention will be better understood as well as further objects and advantages become more apparent from the ensuing detailed specification of a preferred exemplary embodiment taken in conjunction with the drawing.

DESCRIPTION OF THE PREFERRED EMBODIMENT

Figure 1:
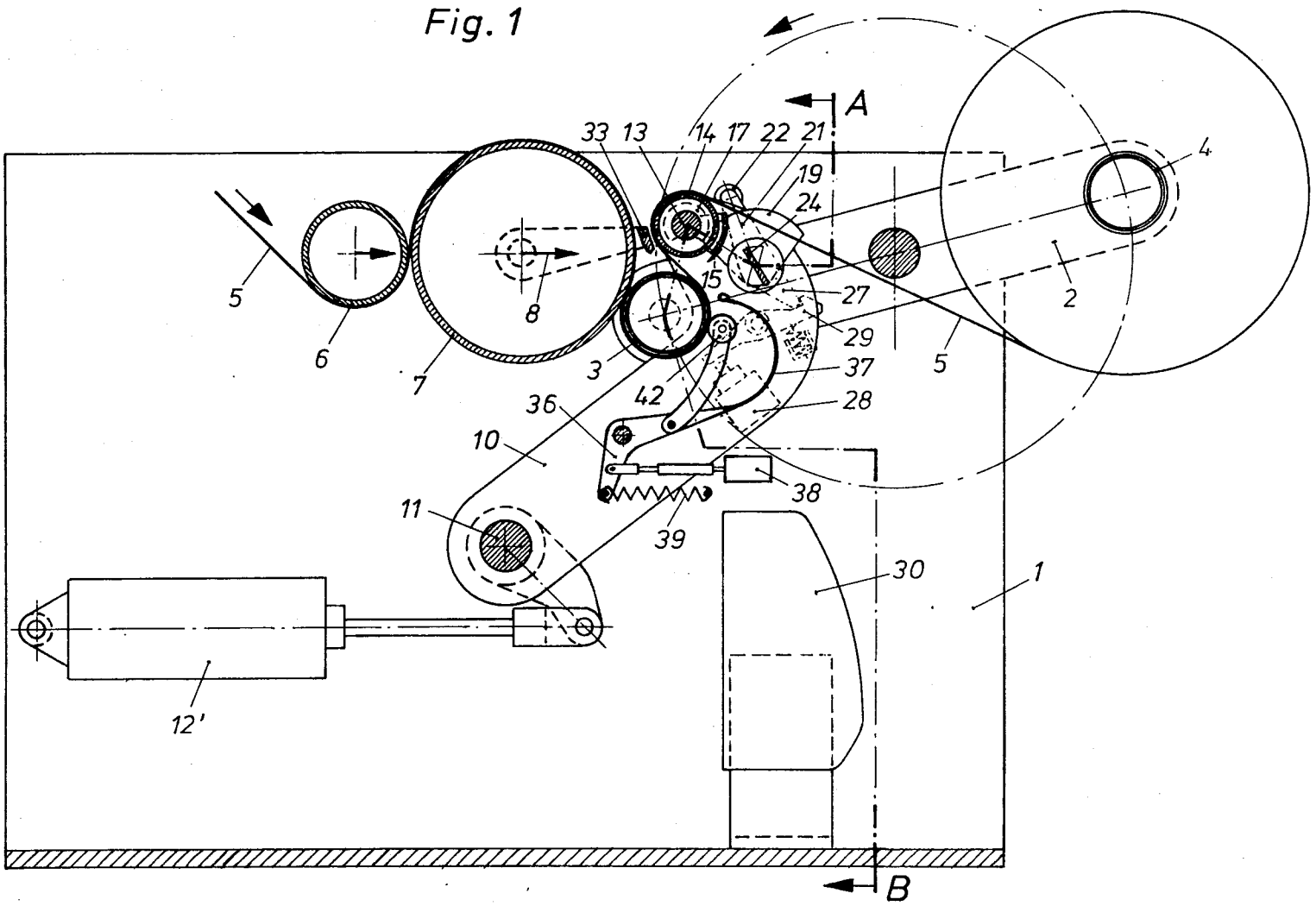
FIG. 1 is a schematic representation of a side view of a double wind-up machine illustrating the mechanisms for the supply and lateral severing of the web material.

Turning now to FIG. 1, there will be seen the side walls of a machine frame 1 in which is pivotably carried a tilting frame 2 which holds the two web spools 3 and 4. The web 5 to be wound up is fed to the empty spool 3 around a reversing roller 6 and a pressure roller 7, the latter being capable of displacement in known manner so that, when the diameter of the material wound up on the spool 3 increases, it may be suitably displaced and continues to press against the roll on the spool 3 with substantially constant pressure in the direction of the arrow 8. In known manner, the spools 3 and 4, as well as the pressure roller 7, are driven by their own or by a common main drive means.

Figure 2:
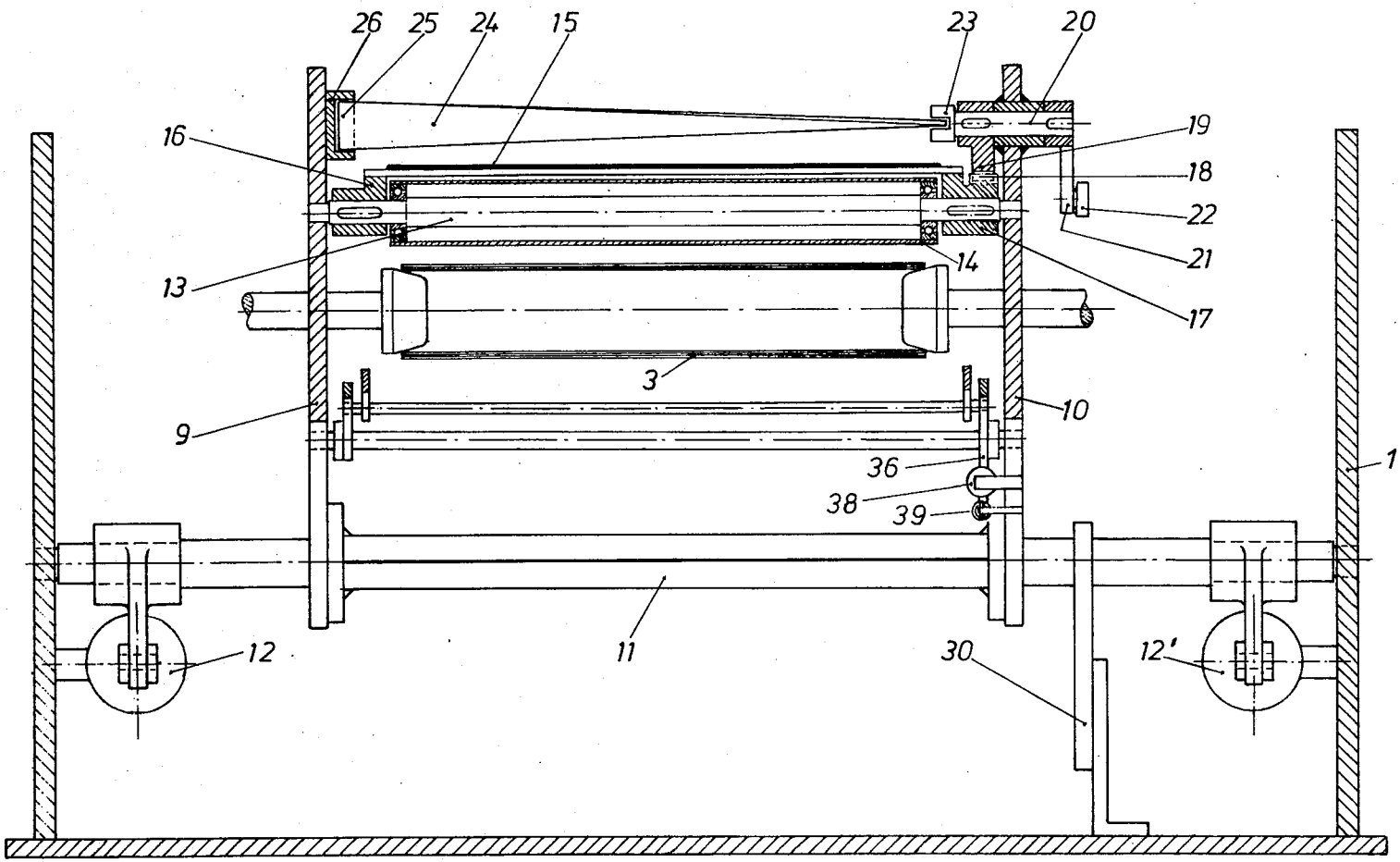
FIG. 2 is a cross section through the machine illustrated in FIG. 1 along the line A-B.

Pivotably mounted on a shaft 11 is a pivotal frame including two parallel arms 9 and 10 which may be rotated by means of two air pressure cylinders 12, 12' and which carries a shaft 13 on which a reversing roller 14 is rotatably disposed by means of ball bearings and whose respective ends carry bushings 16 and 17 on which is fastened a laterally extending severing knife 15. The bushing 17 is provided with a number of gear teeth 18 which engage mating gear teeth on a sector 19 fastened to one end of a shaft 20 mounted in an arm 10 of the pivotal frame 9, 10. The other end of the shaft 20 carries a lever 21 provided with a roller 22. As best seen in FIG. 2, a slot 23 in the shaft 20 provides support for a torsion leaf spring 24 whose other end engages a slot 25 immovably associated with the pivotal frame arm 9. The hub of arm 21 is connected to a locking bolt 27 which cooperates with a latch 29 that may be actuated by a solenoid 28 (FIG. 1). Mounted on the base of the machine frame 1 is a cam plate 30 the perimeter of which may be engaged by the roller 22 on the arm 21.

Figure 3:
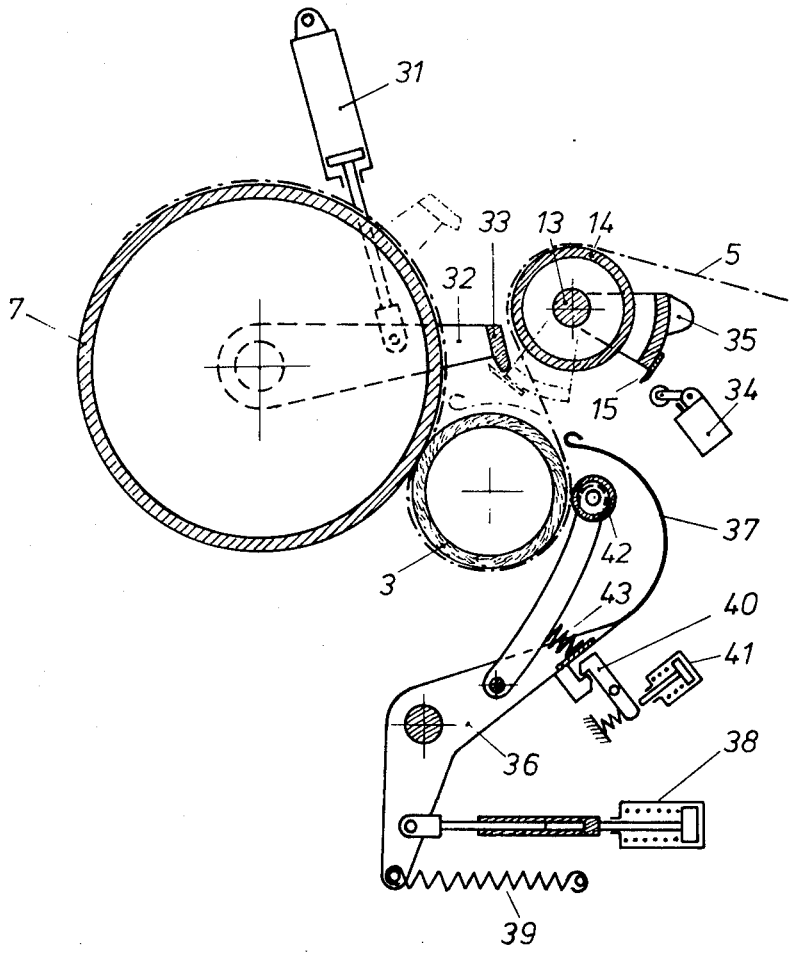
FIG. 3 is an enlarged illustration of the devices which perform the lateral severing and the attachment of the web material onto the surface of the empty spool.

As illustrated in FIG. 3, the shaft of the pressure roller 7 carries a pivotable frame consisting of two parallel levers 32 whose free ends are connected by an anvil 33 which acts as a counter-blade for the severing knife 15. Mounted on the pivotable frame 9, 10 is a secondary pivoting frame consisting of two arms 36 whose free ends are coupled by an elastic sheet-metal guide 37 whose curvature is such that its cross section is approximately semicircular and substantially corresponds to the curvature of the empty spool 3. A pressure cylinder 38 is capable of moving the secondary pivoting frame 36 into the position shown in FIG. 3 in opposition to the pull of a spring 39 and it may be locked in that position by means of a latching bolt 40 which is releasable by another air pressure cylinder 41. Also pivoting on the arms 36 is a pressure roller 42 which is held in the position shown in FIG. 3 by a spring 43 which urges it against the empty spool 3.

The position of the cooperating elements of the machine illustrated in FIG. 3 is that which they occupy just prior to the cutting of the web. The roll 4 which is almost completely wound up is shown in the position where it may be removed from the machine, whereas the empty spool 3 is shown in its normal wind-up position. The web 5 still extends from the pressure roller 7 over the empty spool 3 to the full spool 4 and its path is directed by the reversing roller 14 which is pressed against the web 5 by the upward pivotal motion of the pivoting frame 9, 10. The torsion spring 24 is tensed and is locked in that position by the engagement of the bolt 27 in the latch 29. At this time, the solenoid 28 is energized so that the torsional spring 24 is released and tends to relax so that it rapidly drives the severing knife 15 into the position shown dotted in FIG. 3 at very high speed. After the pivotal frame 9, 10 has moved into position and just prior to the release of the torsion spring 24, the pressure cylinder 31 has been activated so that the counter blade anvil 33 is rapidly pivoted into the position shown in FIG. 3. As a result, the severing knife 15 first encounters the web 5 traversing between the empty spool 3 and the reversing roller 14 and shortly thereafter encounters the counter blade anvil 33. The anvil 33 prevents any lateral deviation of the web 5 away from the knife so that the web is securely severed when the knife arrives at the anvil 33.

During the passage of the severing knife to the anvil, a cam 35 on the knife carrier actuates a limiting switch 34 which energizes the air pressure cylinder 41 and thus causes the release of the pivotal frame 36. As a consequence, the spring 39 is able to pull the pivotal frame 36 from the position shown in FIG. 3 in the counter-clockwise direction. During the motion, the curved guide 37 elastically engages the empty spool 3 and its free end smoothly pushes the web onto the surface of the empty spool 3 and in so doing, displaces any air between the web and the spool so that a smooth attachment of the web to the spool is insured. At the end of its travel, the elasticity of the guide 37 tends to make its free end lift off from the spool 3 so that it does not interfere with the introduction of the end of the web between the spool 3 and the pressure roller 7. A contact roller 42 pressing against the spool 3 prevents the end of the web from falling from the spool 3 until such time as the guide 37 becomes effective.

The just severed end of the web is now wound up on the spool 3. The wound-up roll 4 is removed and an empty roll is inserted in its place. In the meantime, the air pressure cylinder 31 returns the counter blade anvil 33 into the position indicated in FIG. 3 with dotted lines. The main pivotable frame 9, 10 is also returned to its initial position and, near the end of its travel, the roller 22 engages the cam plate 30 which turns the arm 21 and re-tenses the torsional spring 24. Finally, the air pressure cylinder 38 causes the pivotal frame 36 to be rotated in the clockwise sense and against the force of the spring 39 until it reaches its initial position in which it is locked by the action of the bolt 40.

The preceding relates to a preferred exemplary embodiment of the invention, it being understood that variants thereof are possible within the spirit and scope of the invention, the latter being defined by the appended claims.

What is claimed is:

1. In an apparatus for spooling webs which includes a base;
   spool holding means pivotably attached to said base for holding and for orienting at least one spool relative to said base;
   roller means, attached to arms pivoting on said base for engaging and displacing a web being wound up on one of said spools; the improvement comprising:
   cutter means pivotably attached to said shaft supporting said roller;
   said guide roller supported adjacent to the termini of said arms comprising a framework;
   energy storage means carried by said swivelable framework in proximity to said guide roller for powering the pivoting of said cutter means; and
   pivotable anvil means for cooperating with said cutter means to sever said web.

2. An apparatus as defined by claim 1, further comprising:
   elastic web guide means, pivotably attached to said arms, the shape of said guide means substantially conforming to the contours of said spool when empty, for engaging said web after severing and for guiding the end thereof onto said empty spool.

3. An apparatus as defined by claim 2, further comprising:
   cam means, attached to said base, and cam follower means, affixed to said energy storage means; whereby, when said arms are pivoted, the cooperation of said cam means and said cam follower means transfers potential energy to said energy storage means.

4. An apparatus as defined by claim 3, wherein said energy storage means is a torsional spring and said cam follower means is a lever which twists said torsional spring.

5. An apparatus as defined by claim 1, in which said energy storage means comprises a transversely disposed torsional leaf spring member, one end of which is immovably mounted in one of said arms while the opposite end of said spring member is rotatably affixed to said other arm.

* * * * *